United States Patent [19]

Wallin

[11] Patent Number: 4,805,677

[45] Date of Patent: Feb. 21, 1989

[54] APPARATUS FOR REMOVING BARK FROM CUT LOGS

[76] Inventor: Alrik Wallin, 1907 Bahia Mar Dr., Stone Mountain, Ga. 30087

[21] Appl. No.: 197,655

[22] Filed: May 23, 1988

[51] Int. Cl.[4] ..... B27C 9/00

[52] U.S. Cl. ..... 144/208 B; 144/208 R; 144/341

[58] Field of Search ..... 144/208 R, 208 B, 340, 144/341

[56] References Cited

U.S. PATENT DOCUMENTS

| | | | |
|---|---|---|---|
| 1,966,153 | 7/1934 | Thorne | 144/208 B |
| 2,125,529 | 8/1938 | Ullgren | 144/208 |
| 2,647,548 | 8/1953 | Guettler | 144/208 B |

FOREIGN PATENT DOCUMENTS

| | | |
|---|---|---|
| 589550 | 12/1933 | Fed. Rep. of Germany . |
| 78097 | 2/1951 | Norway . |
| 164972 | 5/1954 | Sweden . |
| 835746 | 7/1979 | U.S.S.R. . |

*Primary Examiner*—W. Donald Bray
*Attorney, Agent, or Firm*—Nils H. Ljungman

[57] ABSTRACT

An apparatus for removing bark from cut logs where the logs, stacked parallel to each other, are brought both to rotate and to move back and forth in the direction of their length during simultaneous movement sideways and in restacking. The movement of the logs is achieved by feeding the logs into a stationary container equipped with at least one level movable bottom section, a feeder side slightly sloped toward the bottom section, two planar, vertical gable sides and a discharge side sharply angled toward the bottom section. The bottom section of the container has at least one oblong section vertically and laterally movable, which, at its short end, is hung to rotate on eccentric shafts or the like. At least one of the eccentric shafts is equipped with a drive mechanism meant to cause, in each bottom section, a movement, as seen from the long side of the bottom section, and a chiefly circular path in which the imagined axis of rotation of the bottom section is horizontal and at right angles to the length of the logs.

17 Claims, 2 Drawing Sheets

APPARATUS FOR REMOVING BARK FROM CUT LOGS

BACKGROUND OF THE INVENTION

1. Field of the Invention

The present invention relates to a device for removing bark from cut logs, where the logs, stacked parallel to each other, are made to rotate and to move back and forth along their lengths, and also to move sideways. By using the apparatus of the present invention, the logs are effectively debarked by intensive rubbing, shearing and pressing of one surface of a log against another exposed log surface; knots are also effectively removed by use of the apparatus of the present invention.

2. Description of the Prior Art

Many products manufactured from logs, e.g., fine paper, cardboard and pressed wood, require a very thorough removal of bark from the raw material from which these products are manufactured. There does not currently exist on the market any apparatus that effectively removes bark from cut logs; nor is there any currently marketed debarking apparatus that satisfied the current high demands placed on a debarking apparatus for space taken up by the apparatus, for the capacity of the apparatus, and for cost effectiveness.

The drawings of German Patent No. 589 550 disclose movable sections of a debarking apparatus in which one end of the movable sections moves in a circular path.

The specification of Ullgren, U.S. Pat. No. 2,125,529, describes the design of debarking apparatuses which were available in the 1930's. These included: large rotating drums of cylindrical or conical shape; a stationary debarking apparatus using chain-conveyors; and an apparatus in which logs, floated on water and moved, are debarked by a series of rollers. The disadvantages are described in the Ullgren Patent. The claimed apparatus of Ullgren also uses rollers to remove bark from logs. The Ullgren patent also suffers from many of the disadvantages of the prior apparatuses.

Russian Patent No. 835746 discloses, in the drawings, a debarking apparatus using blades and a conveyor to remove bark and to move the debarked logs to a finished area.

The drawings of Norwegian Patent No. 78097 also appear to disclose a debarking apparatus which uses blades and a water spray to remove bark from logs.

The drawings of Swedish Patent No. 164972 appear to disclose a debarking apparatus which uses a hopper, a moving conveyor in the hopper, and friction action of log rubbing against log to remove bark.

All of the above-described debarking apparatuses suffer from one or more of the following disadvantages: inadequate debarking, high cost, and damaged useable wood.

In light of the disadvantages of the prior art debarking apparatuses, it was deemed desirable to develop a debarking apparatus to debark various log types, and to feed especially long log types, such apparatus to assure small loss of usable wood, to assure that logs are nearly free of bark, and which at the same time would be both simple and cheap, and have small space requirements, i.e., an apparatus which is easy to install into existing systems.

All of the above-cited patents are incorporated herein by reference as if the entire contents thereof were fully set forth herein.

OBJECT OF THE INVENTION

It is therefore an object of the present invention to solve the technical, cost and space problems associated with existing debarking apparatuses.

SUMMARY OF THE INVENTION

The apparatus for removing bark from cut logs of an embodiment of the present invention comprises: a container for receiving cut logs, equipped with a feeder for feeding the logs; a discharge means for discharging the debarked logs, a means disposed within the container for removing bark from cut logs, which has at least one horizontally and vertically movable section; and a means for moving the section, whereby the moving means maintains at least one movable section substantially horizontal during movement, while at the same time at least one movable section moves in both vertical and horizontal direction.

The apparatus is further characterized by at least one movable section of the container being at least one oblong section horizontally movable. This section, at both its ends, is mounted in order to move in a circular or elliptical path by the use of bearings on eccentric shafts, having eccentric portions or the like. At least one of the eccentric shafts is equipped with a drive mechanism designed to cause movement in each movable section, as seen from the long side of the movable section. This movement takes a chiefly circular path in which the apparent axis of rotation of the movable section is horizontal and at right angles to the length of the longitudinal axes of the sections along which the longitudinal axes of logs are oriented.

It is desirable that the movable sections of the container has two vertically and horizontally movable oblong sections, with separate vertical sides. Both short ends of these oblong sections are mounted to move in a circular path by the use of bearings on eccentric shafts. The vertical sides, preferably attached to their respective oblong sections, follow these sections in their movements and prevent the logs from sliding lengthwise excessively. The discharge and feeder portions of the container prevent the logs from sliding sideways excessively.

One aspect of the invention resides broadly in an apparatus for removing bark from cut logs, the apparatus including: a container for receiving cut logs; a feeder for feeding cut logs into the container; a discharge apparatus for discharging debarked logs from the container. The container has means disposed therein for removing bark from cut logs. The debarking apparatus has at least one horizontally and vertically movable section and an apparatus for moving at least one section. The moving apparatus has an apparatus for maintaining the at least one section, which is substantially horizontal during movement and which moves substantially all parts of at least one of the at least one section, in unison, in both vertical and horizontal directions.

Another aspect of the invention resides broadly in an apparatus for removing bark from cut logs which includes: a container for receiving cut logs; a feeder for feeding logs; a discharge apparatus for discharging debarked logs; and the container apparatus which is disposed therein for removing bark from cut logs; the debarking apparatus having at least one section, and which is movable horizontally and vertically, the at least one section is preferably integral at both ends with eccentric shafts, and the eccentric shafts are preferably eccentric and/or rotatable; an apparatus for moving at least one of the eccentric shafts, the moving apparatus for displacing the at least one section, in a movement along a longitudinal dimension of the at least one section, the movement being substantially circular and the at least one section is movable about an axis of rotation for being disposed substantially horizontal and at substantially right angles to a length dimension of the logs being debarked.

Other objects, features and advantages of the present invention will become more fully apparent from the following detailed description of the preferred embodiment, the appended claims and the accompanying drawings in which:

DESCRIPTION OF THE PREFERRED EMBODIMENTS

Figure 1:
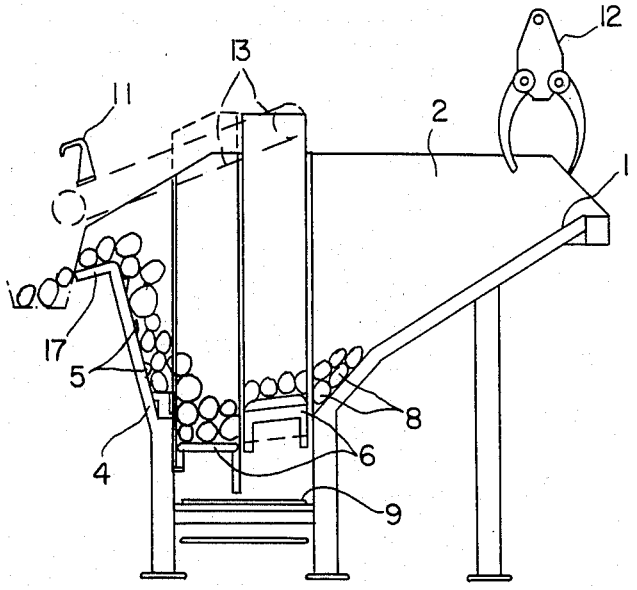
FIG. 1 is a vertical section of one embodiment of the apparatus for removing bark from cut logs of the present invention, this embodiment showing the apparatus with two movable sections.
Figure 2:
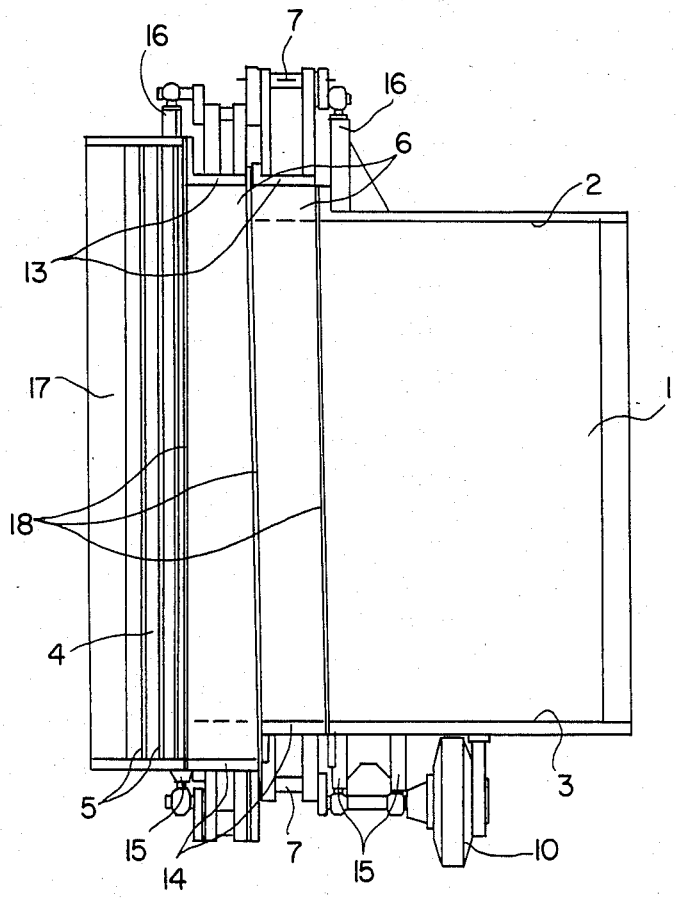
FIG. 2 is a top view of the embodiment of FIG. 1.

The preferred embodiment of the debarking apparatus of this invention is illustrated by way of example in FIGS. 1 and 2.

Referring to FIGS. 1 and 2, the present invention is shown in front vertical view in FIG. 1 and in top view in FIG. 2, with a stationary container equipped with a generally level bottom, a feeder side 1 sloping slightly toward the bottom to receive cut logs. There are two plane, vertical, gable sides 2 and 3 and one discharge side 4 relatively steeply sloping toward the bottom. The discharge side 4 is equipped with evenly spaced, stairway-like shelves 5 as well as preferably one collection area 17 to receive the debarked logs. The collection area 17 is preferably set at an obtuse angle to the side 4.

Further, in accordance with the apparatus of FIGS. 1 and 2, the apparatus is equipped with two oblong bottom sections 6, movable up, down and lengthwise, with separate vertical side gables 13 and 14, with bottom sections 6 being, at both their short ends, mounted to rotate on bearings on eccentric shafts 7. As seen in the preferred embodiment of FIGS. 1 and 2, the eccentric shafts 7 are constructed as crankshafts of varying diameters and circumferences and are preferably mounted horizontally and parallel to the gable sides 2 and 3 of the holder, to which the crankshafts are attached by bearing-containing mounting devices 15 and 16. So that the bottom sections 6 can be caused to move in chiefly circular paths, as viewed from their long dimension, one of the eccentric shafts 7 has been supplied, in the preferred embodiment, with a drive mechanism 10 in the form of a hydraulic motor. The bottom sections 6 are generally oblong.

In FIG. 1, a load of logs 8 to be debarked is fed into the apparatus. The logs are fed into the container at its feeder side 1 by means of a crane outfitted with a gripping device 12, whereupon, the logs slide and roll down toward and partly into the bottom sections 6. It may be desirable for a storage area to be located between the crane and the container, where the logs are collected to be later fed all at once into the container.

When the bottom sections 6 execute their movements, the container and the bottom sections are constructed so that the logs move, via the support of shelves 5, and climb upward toward the discharge side 4. Because of the movements of bottom sections 6, constant restacking of the logs occurs. Constant shifting of the logs 8 also occurs parallel to the long dimension of feeder side 1 as the logs move toward the discharge side 4. Because the logs are lying on top of each other, there occurs a simultaneous pressure on the underlying logs. When the bottom sections 6 execute their above-referenced circular movement, the pressure on the underlying logs provides the necessary friction to remove the bark from the logs and also, in some cases, to remove knots from the logs.

When a log reaches the collection area 17, located at the upper end of the discharge side 4, it is inspected, by visual or other means, and, if the debarking result is not acceptable, the log is sent back to the feeder side 1 with the help of a transport device 11. Such transport devices are known in the art. After being transported back to feeder side 1, the log, since it has not been adequately debarked, is sent through the apparatus again. Once the log has been adequately debarked, it falls into the collection area 17, and onto a conveyor belt or the like for transport to a saw, chipper, etc., depending on the use for the debarked wood.

Between the outer edges of the bottom sections 6 and the bottom edges of the container, as well as between the inner edges of the bottom sections 6 which incline toward each other, there are long narrow slots 18 through which the removed bark and knot parts are continuously fed down to an underlying conveyor belt 9 for removal from the apparatus. To reduce the size of the pieces of the removed material, and to assist its feed downward, there are knife-like devices mounted to the edges of the bottom section and container within the above-named slot area 18.

Although it is not shown in the Figures, it can be appreciated from the above explanation of the present invention, that the upper log bearing surfaces of the bottom sections 6 can be arranged at various angles relative to one another and at various angles with respect to the horizontal plane. Further, the bottom sections 6 can move in shallow arc-shaped paths instead of circular paths.

it is preferred that the apparatus have eccentric shafts which are common to all of the bottom sections of the container, and that the eccentric shafts be constructed preferably as crankshafts of varying diameters and circumferences so that each bottom section can be made to move in phase relationship to that of its nearest adjacent bottom sections. Because of this phased movement, friction is naturally intensified between the logs lying on the separate bottom sections, and this increased friction considerably increases the debarking effect of the apparatus. According to the preferred embodiment of the present invention, the upper, level, log-bearing surfaces of the bottom sections 6 are situated at different angles to the horizontal plane, and the surfaces are covered with a friction coating or other type friction elements on all or parts of the surfaces.

As an alternative embodiment, the movable oblong bottom sections can, at their short ends, be cradled to rotate on slewing brackets. By this means, the advantage of the movement of the sections is achieved in shallow arc-shaped paths, with the help of a push-pull drive mechanism of the hydraulic cylinder type, or the like.

Regarding the construction of the stationary container, it has been proven expedient and most efficient to have the width of the container preferably exceed the length of the longest logs by at least 15 centimeters, and to provide the sloped discharge side of the container with preferably at least four, evenly spaced, stairway-like shelves, as well as a collection area for the debarked logs at the top, the collection area preferably being set at an obtuse angle to the sloping surface of the discharge side of the container.

In certain cases, especially when the logs are dry and light, it is advantageous that some sort of load be brought to bear on the logs on the bottom section or sections to press the logs downwardly and increase the friction between the logs. Such a load can be appropriately achieved by the use of blasting mats, used-rubber mats, ship chains, or the like, in the stationary container. This loading does not hinder the movement and rotation of the logs, but presses them downward against each other so that the friction between them, as well as against the bottom sections, is increased.

Figure 3:
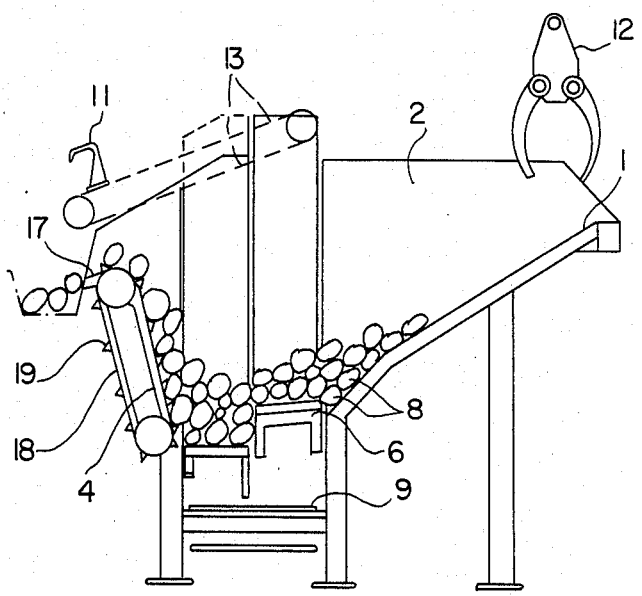
FIG. 3 is a vertical section of another embodiment of the present invention showing a train conveyor used to discharge the logs after their bark has been removed by the apparatus of the present invention.

Referring to FIG. 3, which is an alternative embodiment of the present invention, there is shown an alternative discharge mechanism to that of FIGS. 1 and 2. In FIG. 3, the wall of the discharge side 4 is equipped with chains 18. The chains 18 are equipped with flights 19 to form a chain conveyor covering the full width of the apparatus. This chain conveyor will control the discharge rate of the debarked logs. The flights 19 pick up the logs from the bottom of the container and raise them from the bottom to the top of the discharge side 4 and deposit the logs in the collection area 17.

According to the present invention, when using the apparatus for removing bark from cut logs, a number of advantages are obtained compared to the debarking machines of the prior art. The apparatus of the present invention is much simpler and requires less space than, for example, a debarking drum, which makes the present invention both cheaper and easier to install into a production system. Furthermore, wear on the apparatus caused by the logs will be considerably less than on prior art devices because there is normally no friction contact between the stationary parts of the apparatus and the logs which are in movement, and because only a small portion of the logs come into contact with the parts of the apparatus.

Another important advantage of the present invention is that the end surfaces of the logs are, to a large extent, spared any damage. Further, the logs are insignificantly subjected to bending, which diminishes considerably the number of logs broken during debarking. Because of this, wood loss is decreased in comparison that which occurs with debarking machines of the prior art.

Other advantages of the present invention include the breadth of the apparatus, in which long logs can be accommodated without any great inconvenience, and in which the debarking of every discharged log can be easily judged. Also, if the debarking is unacceptable, the log in question is easily returned to the feeder side with the help of the transport device installed on the apparatus.

Another advantage of the present invention is that the log capacity of the apparatus is dependent on the number of bottom sections constructed into the apparatus. The capacity of the apparatus is, therefore, flexible; bottom sections can be added or subtracted in accordance with the desired log capacity of the apparatus.

In summing up, an embodiment of the invention resides in a device for debarking logs which consists of a stationary holder that is equipped with a generally level bottom, a feeder side 1 for the logs, which is slightly sloped toward the bottom, two plane, vertical gable sides 2, 3, and a discharge side 4, which is sharply angled toward the bottom. The bottom has at least one oblong section 6, which is horizontally and vertically movable, and at both its short ends is attached to rotate via bearings on eccentric shafts 7 or the like, where at least one of the eccentric shafts 7 is equipped with a drive mechanism 10, meant to cause in each bottom section 6 a movement seen from the long side as a chiefly circular path, in which the imagined axis of rotation is horizontal and at right angles to the length of the logs.

Yet another aspect of the invention resides in a device, wherein the bottom displays two oblong sections 6, which are movable both up and down and lengthwise, with separate, vertical side gables 13 and 14. The sections are mounted to rotate at both their short ends or at other locations on the sections via bearings on eccentric shafts 7, whereby the vertically attached side gables 13 and 14, to each of the sections 6, follow these sections in their movements.

And yet another aspect of the invention resides in a device, where the supporting eccentric shafts 7 of the bottom sections 6 are arranged horizontally and at the same time parallel to the gable sides by permanently attached bearing devices 15 and 16.

Still yet another aspect of the invention resides in a device, wherein the eccentric shafts 7 are common to several or all of the bottom sections 6, occurring in the holder. The shafts 7 are constructed as crankshafts of differing compass so that each bottom section 6 can be brought to move, shifted in phase relative to the nearest adjacent bottom section or sections 6.

And still yet another aspect of the invention resides in a device, wherein the upper, level, log-bearing surfaces of the bottom sections 6 are arranged respective to each other at different angles to the horizontal, and that the surfaces are constructed with parts of them, or the whole surface is covered with a friction coating or other type friction elements.

And yet a further aspect of the invention resides in a device, wherein the movable, oblong bottom sections 6 are, at their short ends, mounted to rotate on slewing brackets. The movement of the sections, in this case, in shallow arc-shaped paths, is achieved with the help of a push-pull drive mechanism 10, such as a hydraulic cylinder or the like.

A still further aspect of the invention resides in a device, wherein the breadth of the stationary holders preferably exceeds the length of the longest logs by at least 15 cm and that its steeply sloped discharge side 4 is equipped with preferably at least four, preferably evenly spaced, stairway-like shelves 5, as well as preferably a collecting area 17 for the debarked logs at the top, set at preferably an obtuse angle to its sloped surface.

Yet still a further aspect of the invention resides in a device, wherein it exhibits a transport mechanism 11, meant for the returning of incompletely debarked logs from the holder's collection area 17, to its feeder side 1, and a conveyor belt 9, or the like, designed to carry away the bark and knot parts which collect at the bottom of the holder.

The bottom sections can be designed to remove the bark or debris to one side of the machine.

And still a further aspect of the invention resides in a device, wherein a load is brought to bear on the logs located in the bottom section or sections, so that they are pressed downward and the friction between them is increased.

The invention as described hereinabove in the context of a preferred embodiment, is not to be taken as limited to all of the provided details thereof, since modifications and variations thereof may be made without departing from the spirit and scope of the invention.

What is claimed is:

1. An apparatus for removing bark from cut logs, said apparatus comprising:

a container for receiving cut logs;

a feeder for feeding logs into said container;

a discharge means for discharging debarked logs from said container;

said container having means disposed therein for removing bark from cut logs;

said debarking means having at least one horizontally and vertically movable section;

means for moving said at least one section, said moving means having means for maintaining said at least one section substantially horizontal during movement and for moving substantially all parts of at least one of said at least one section, in unison, in both vertical and horizontal directions.

2. An apparatus for removing bark from cut logs which comprises:

a container for receiving cut logs;

a feeder for feeding logs into said container;

a discharge means for discharging debarked logs from said container;

said container having means disposed therein for removing bark from cut logs:

said debarking means having at least one section which is movable horizontally and vertically, said at least one section being at both ends integral with eccentric shafts, said eccentric shafts being rotatable;

means for moving at least one of said eccentric shafts, said moving means for displacing said at least one section, in a movement, along a longitudinal dimension of said at least one section, said movement being substantially circular and said at least one section being movable about an axis of rotation for being disposed substantially horizontal and at substantially right angles to a length dimension of the logs being debarked.

3. The apparatus for removing bark from cut logs according to claim 2, wherein said at least one section comprises:

two oblong sections movable up, down and lengthwise, and said apparatus further comprises vertical side gables;

said oblong sections being mounted on eccentric shafts for moving said sections in circular paths;

whereby said vertical side gables move integrally with said oblong sections.

4. The apparatus for removing bark from cut logs according to claim 3, wherein said eccentric shafts are arranged horizontally and parallel to said vertical side gables, and said permanently attached bearing devices for cradling said eccentric shafts in said vertical side gables.

5. The apparatus for removing bark from cut logs according to claim 4, wherein said eccentric shafts are integral with said oblong sections of said at least one section, said eccentric shafts further comprising crankshafts of differing diameters and circumferences, whereby each of said oblong sections is movable in phase relative to an adjacent said oblong section or sections.

6. The apparatus for removing bark from cut logs according to claim 3, said oblong sections of said at least one section mounted at their ends to rotate on slewing brackets, whereby the movement of said oblong sections is achieved by a push-pull drive mechanism.

7. The apparatus for removing bark from cut logs according to claim 2, wherein said discharge means has a sloped surface, the breadth of said container exceeds the length of the longest logs by at least fifteen centimeters, said discharge means comprising at least one stairway-like shelf.

8. The apparatus for removing bark from cut logs according to claim 3, wherein said discharge means has a sloped surface, the breadth of said container exceeds the length of the longest logs by at least fifteen centimeters, said discharge means comprising at least four, evenly-spaced stairway-like shelves and a collecting area to receive debarked logs, said collecting area set at an obtuse angle to the sloped surface of said discharge means.

9. The apparatus for removing bark from cut logs according to claim 2, further comprising a transport mechanism to return incompletely debarked logs from said collecting area of said container to said feeder, said transport mechanism further comprising conveyor belt means, said conveyor belt means for carrying away bark and knot parts which collect at the bottom of said container.

10. The apparatus for removing bark from cut logs according to claim 3, said container comprising a loading means for forcing together the logs, located on said at least one section, and for forcing the logs downwardly to increase friction between the logs.

11. The apparatus for removing bark from cut logs according to claim 4, said container comprising a loading means for forcing together the logs, located on said at least one section, and for forcing the logs downwardly to increase friction between the logs.

12. The apparatus for removing bark from cut logs according to claim 1, said container comprising a loading means for forcing together the logs, located on said at least one section, and for forcing the logs downwardly to increase friction between the logs.

13. The apparatus for removing bark from cut logs according to claim 2, said container comprising a loading means for forcing together the logs, located on said at least one section, and for forcing the logs downwardly to increase friction between the logs.

14. The apparatus for removing bark from cut logs according to claim 5, said container comprising a loading means for forcing together the logs, located on said at least one section, and for forcing the logs downwardly to increase friction between the logs.

15. The apparatus for removing bark from cut logs according to claim 6, said container comprising a loading means for forcing together the logs, located on said at least one section, and for forcing the logs downwardly to increase friction between the logs.

16. the apparatus for removing bark from cut logs according to claim 7, said discharge means comprising a collecting area to receive debarked logs.

17. The apparatus for removing bark from cut logs according to claim 16, said collecting area set at an obtuse angle to the sloped surface of said discharge means.

* * * * *